US006254412B1

(12) United States Patent
Muta et al.

(10) Patent No.: US 6,254,412 B1
(45) Date of Patent: Jul. 3, 2001

(54) CONNECTOR

(75) Inventors: Junji Muta; Katsuya Ito, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/450,223

(22) Filed: Nov. 29, 1999

(30) Foreign Application Priority Data

Nov. 30, 1998 (JP) ..... 10-339885

(51) Int. Cl.[7] ..... H01R 13/64
(52) U.S. Cl. ..... 439/246; 439/76.2
(58) Field of Search ..... 439/246, 76.2, 439/688, 860, 247, 248, 816

(56) References Cited

U.S. PATENT DOCUMENTS 5,679,010 * 10/1997 Hotea et al. ..... 439/81
5,707,243 1/1998 Endo et al. ..... 439/76.2

* cited by examiner

*Primary Examiner*—Gary Paumen
*Assistant Examiner*—Alexander Gilman
(74) *Attorney, Agent, or Firm*—Banner & Witcoff, Ltd.

(57) ABSTRACT

An electrical connecting configuration is able to accommodate large variations in assembly tolerances.

Terminal fittings 35 are composed of electrically conductive fixed terminals 36, these fixed terminals 36 being fixed to electric wires 32 and being fixed on a connector unit 20, and movable terminals 37. The movable terminals 37 maintain a contacting state with the fixed terminals 36 and being capable of moving in a direction perpendicular to a direction of joining of two units 10 and 20. If terminal members 16 and the terminal fittings 35 show a dislocation in position when the two units 10 and 20 are to be joined together, the terminals 37 within the terminal fittings 35 change position, thereby absorbing the dislocation in position and allowing the terminal members 16 to fit without hindrance.

14 Claims, 8 Drawing Sheets

21
20
23
22
32
10
16
14U
16
16
13A
12
14U
13
14L
12
15
16
11

CONNECTOR

TECHNICAL FIELD

The present invention relates to an electrical connecting configuration for a coil unit provided with a plurality of coils distributed in specific locations and a connector unit provided with connecting members distributed so as to correspond with the coils.

A solenoid unit for controlling oil pressure is provided within a gearbox casing of an automatic transmission of an automobile. A connector unit attached to a wire harness outside the gearbox casing provides electricity to coils of this solenoid unit. An example of this connector unit is described in the laid open publication JP-9-55235. The solenoid unit thereof is provided with a coil unit having a plurality of coils distributed at specified locations on a base, these coils being fixed thereto, each of the coils being provided with a separate protruding terminal. The connector unit thereof has a plurality of plate-shaped terminal fittings distributed on the base so as to correspond to each of the coils. An attachment hole and a resilient clamping member protruding upwards from the hole edge of each attachment hole are formed on each plate-shaped terminal fitting. When a connector housing is attached to the coil unit, the protruding terminals pass through the attachment holes and are gripped by the resilient clamping members. The coil unit and the connector unit thereby attain an electrically connected state.

In the above example, the plurality of plate-shaped terminal fittings are positioned individually to correspond to the plurality of coils, and the two units are joined. In this configuration, even the dimensional error of each component and the attachment error of each unit are within a range of tolerances, this error accumulates when the two units are joined and consequently there is the danger of a larger dislocation appearing in position between the protruding terminals and the plate-shaped terminal fittings, thereby preventing the two units from fitting together smoothly.

The example disclosed in the above publication addressed this problem by providing resilient clamping members on the attachment holes into which the protruding terminals are fitted, these resilient clamping members being capable of bending resiliently. This resilient change of position is the means to absorb the dislocation in position. However, with this method, the maximum extent of dislocation absorption is limited to the greatest bending capacity of the resilient clamping members, and there are cases where the dislocation absorption is insufficient.

The present invention has been developed after taking the above problem into consideration, and aims to present an electrical connecting configuration in which the dislocation absorbing function of an electrical connecting member between a coil unit and a connector unit is superior.

SUMMARY OF THE INVENTION

According to the invention, there is provided an electrical coil unit comprising a base, a plurality of coils distributed on the base and each having a terminal, and a connector having a plurality of contacts engageable one each with said terminals; characterised in that said terminals and contacts have a fitting direction, and each of said contacts comprises a fixed conductor and a movable conductor, said fixed conductors being immovable with respect to said connector, and said movable conductors being in electrical contact with a respective fixed conductor and movable with respect thereto in a plane perpendicular to said fitting direction.

Preferably either the fixed conductors or movable conductors has a resilient contact member for maintaining electrical contact therebetween.

The terminals preferably comprise upstanding pins of for example circular cross-section.

The movable conductors preferably include resilient arms for contact with respective terminals.

In the preferred embodiment, the fixed conductor confines movement of the movable conductor by means of a peripheral wall. The fixed conductor preferably substantially encloses the movable conductor, and may be folded from a sheet metal blank.

BRIEF DESCRIPTION OF THE DRAWINGS

Other features of the invention will be apparent from the following description of a preferred embodiment shown by way of example only in the accompanying drawings in which.

DESCRIPTION OF PREFERRED EMBODIMENT

Figure 1:
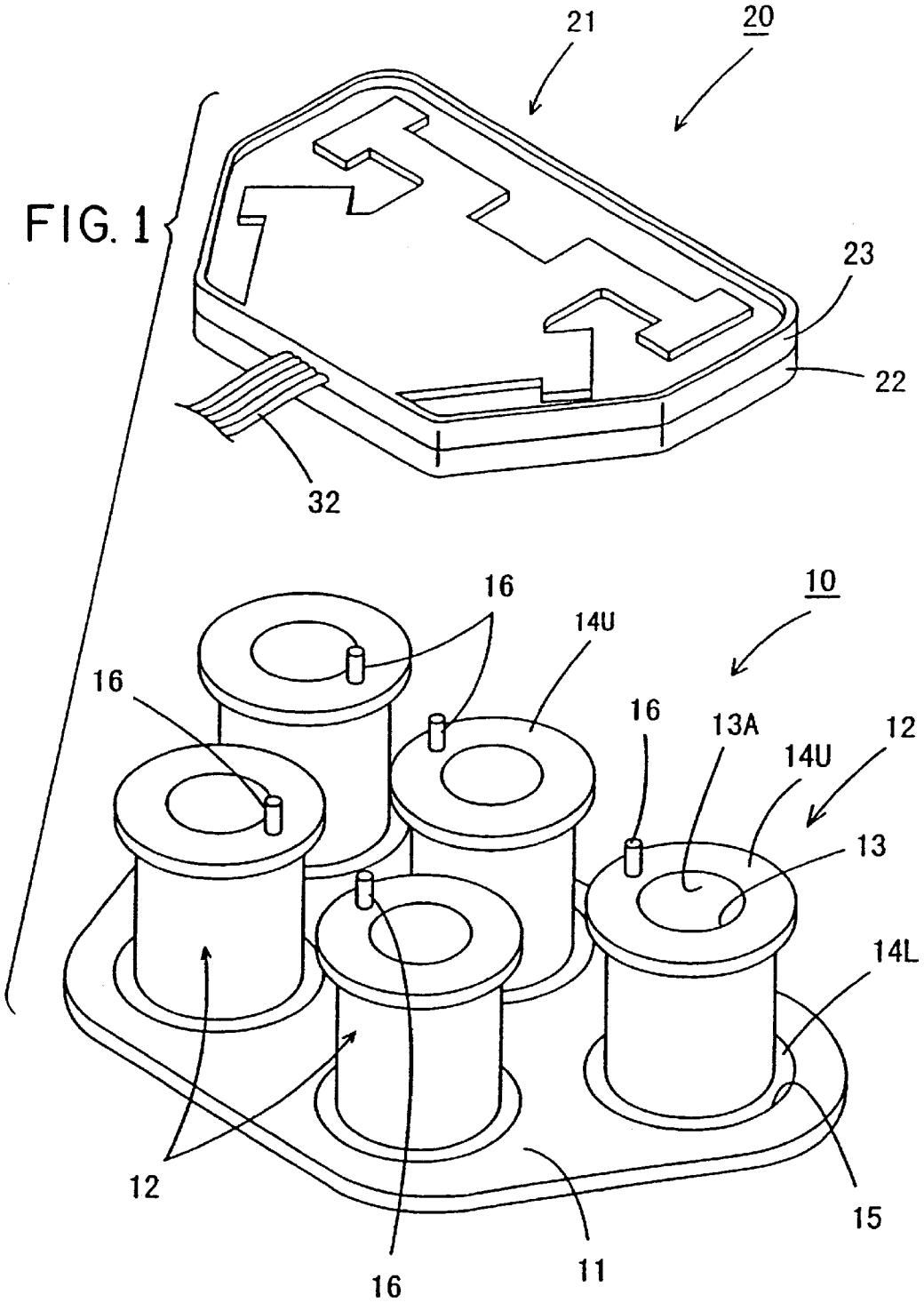
FIG. 1 is a diagonal view showing a coil unit and a connector unit of embodiment 1 in a separated state, the ends thereof abutting.
Figure 2:
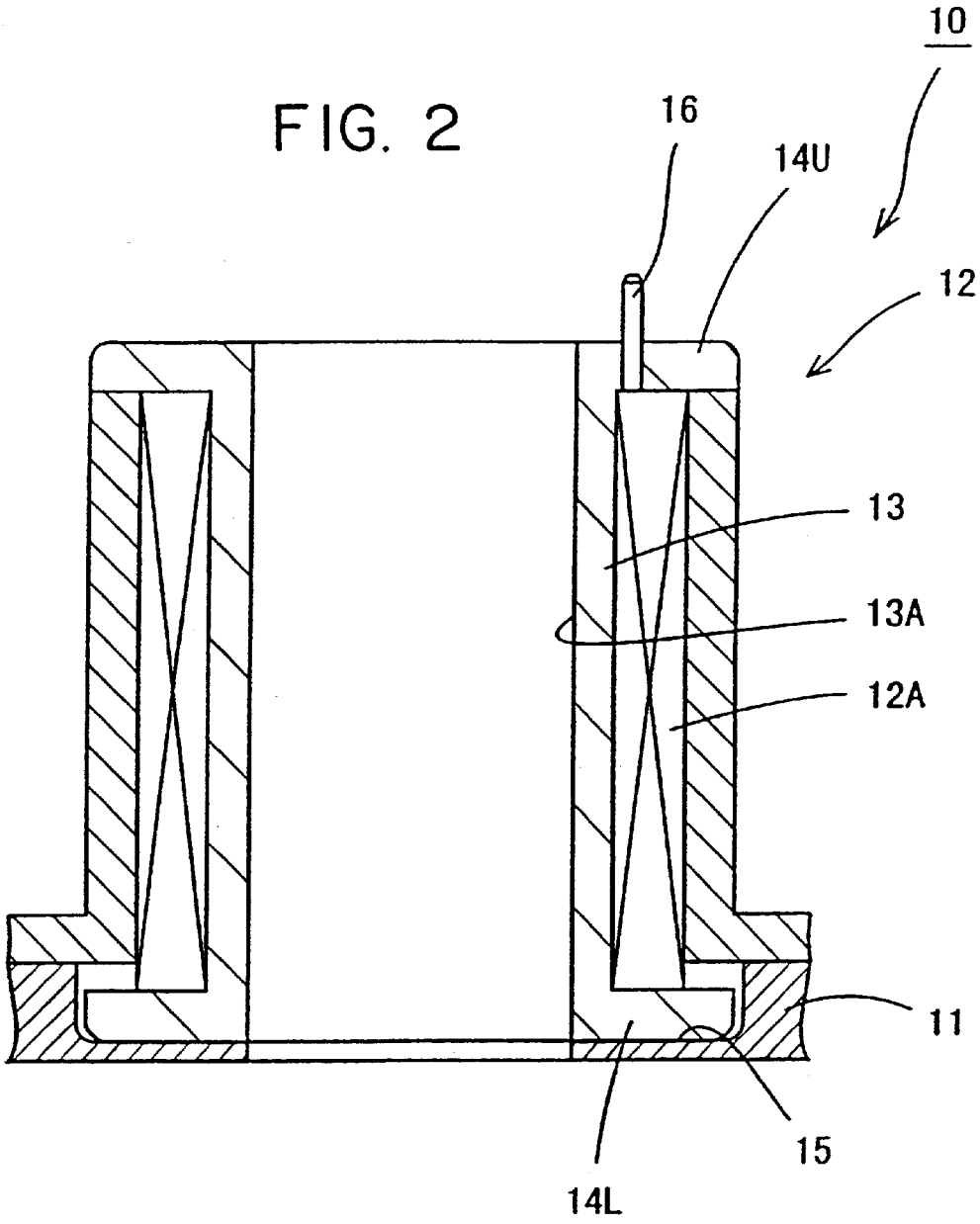
FIG. 2 is a partially expanded cross-sectional view of the coil unit.
Figure 3:
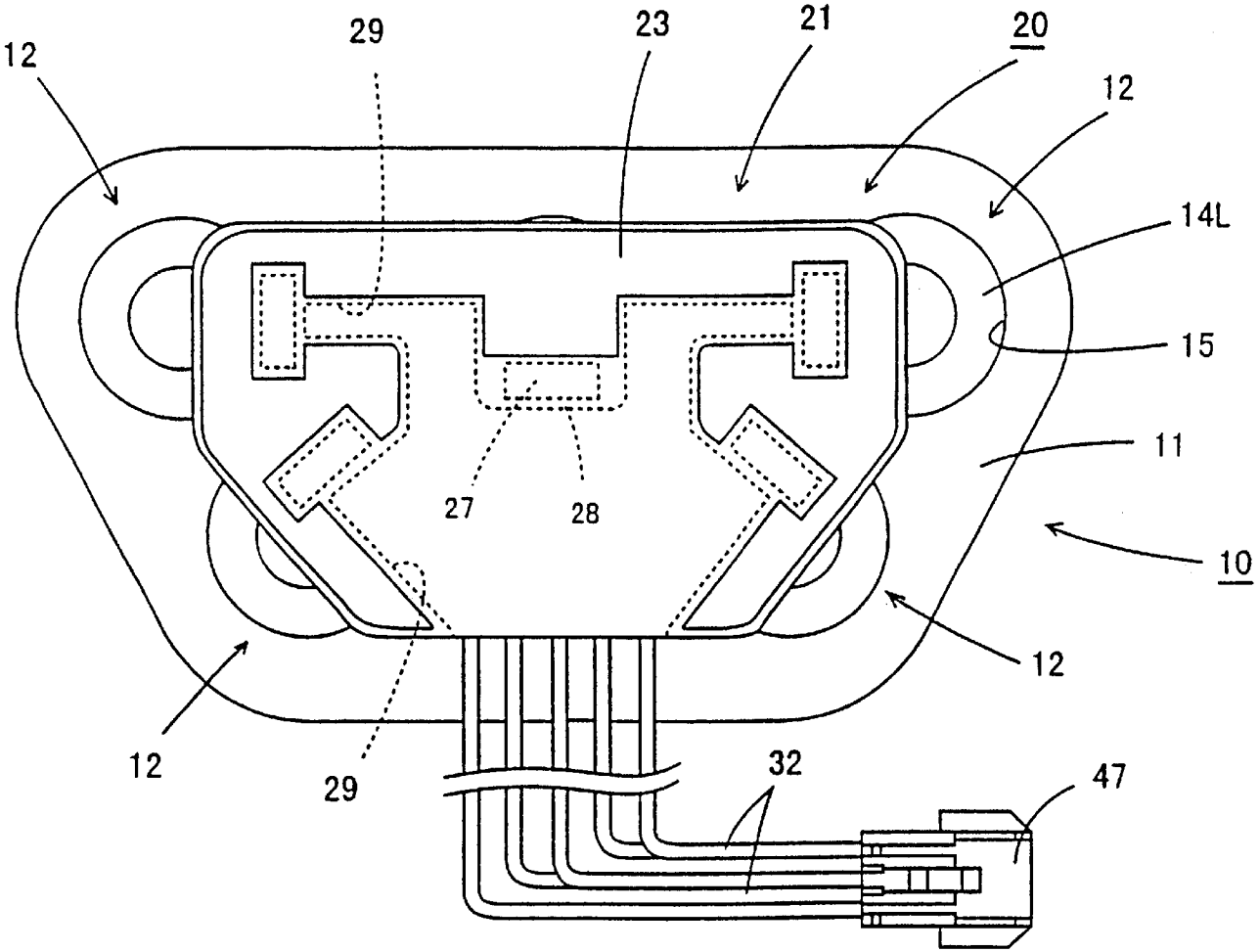
FIG. 3 is a plan view showing the connector unit joined with the coil unit.
Figure 4:
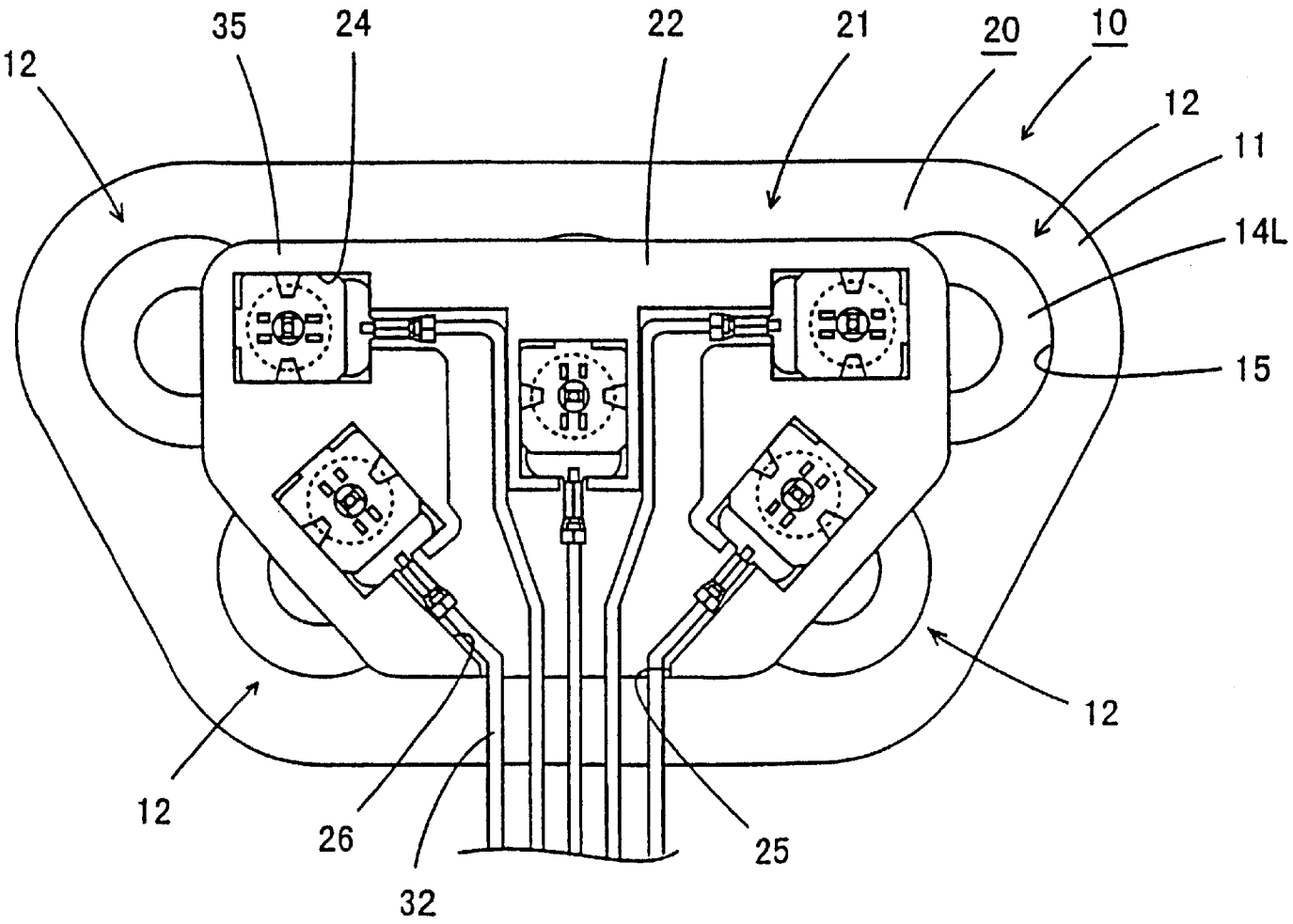
FIG. 4 is a plan view showing the connector unit in a joined state with a cover of a housing removed.
Figure 5:
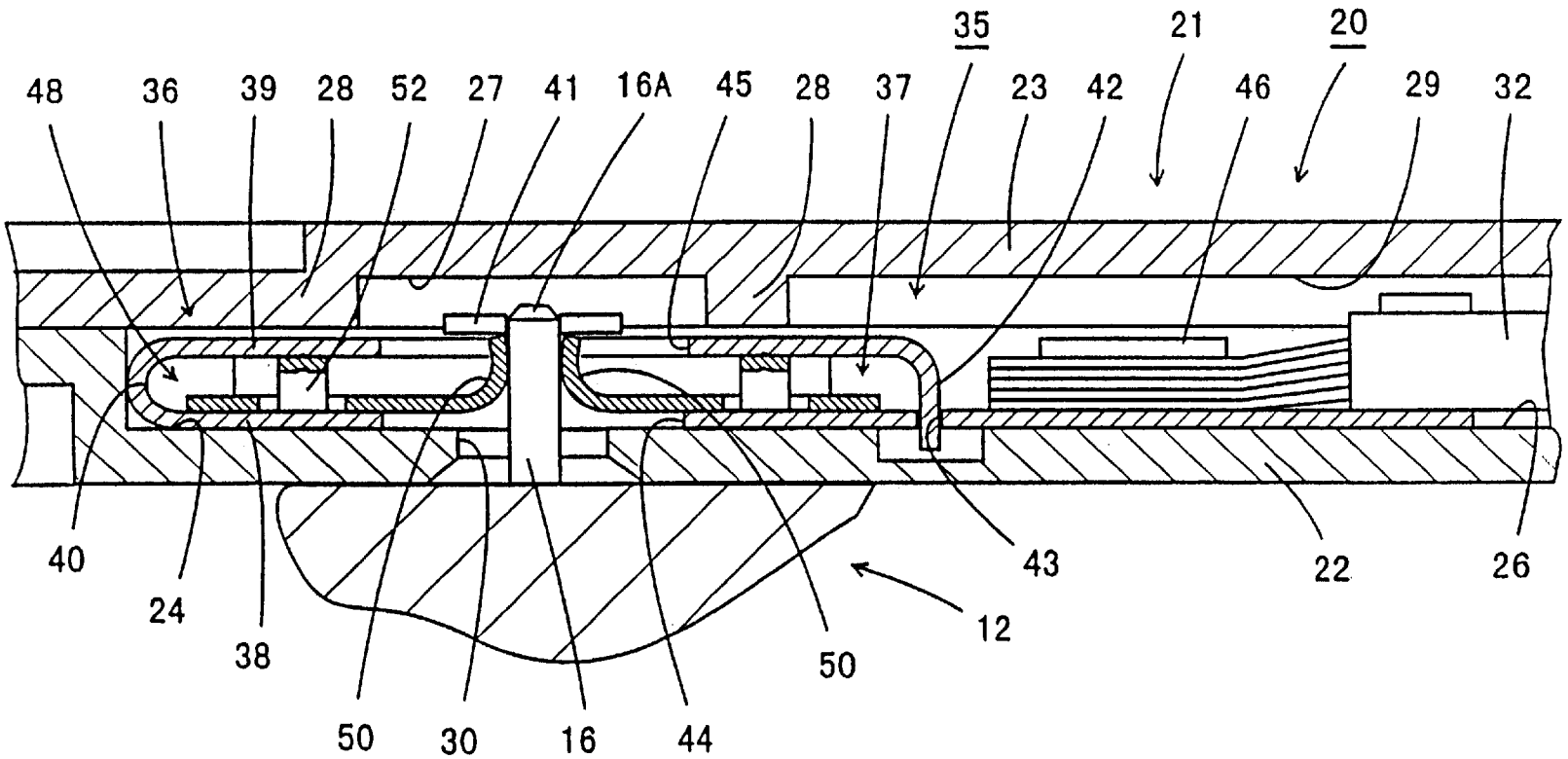
FIG. 5 is a partially expanded cross-sectional view showing the two units joined together.
Figure 6:
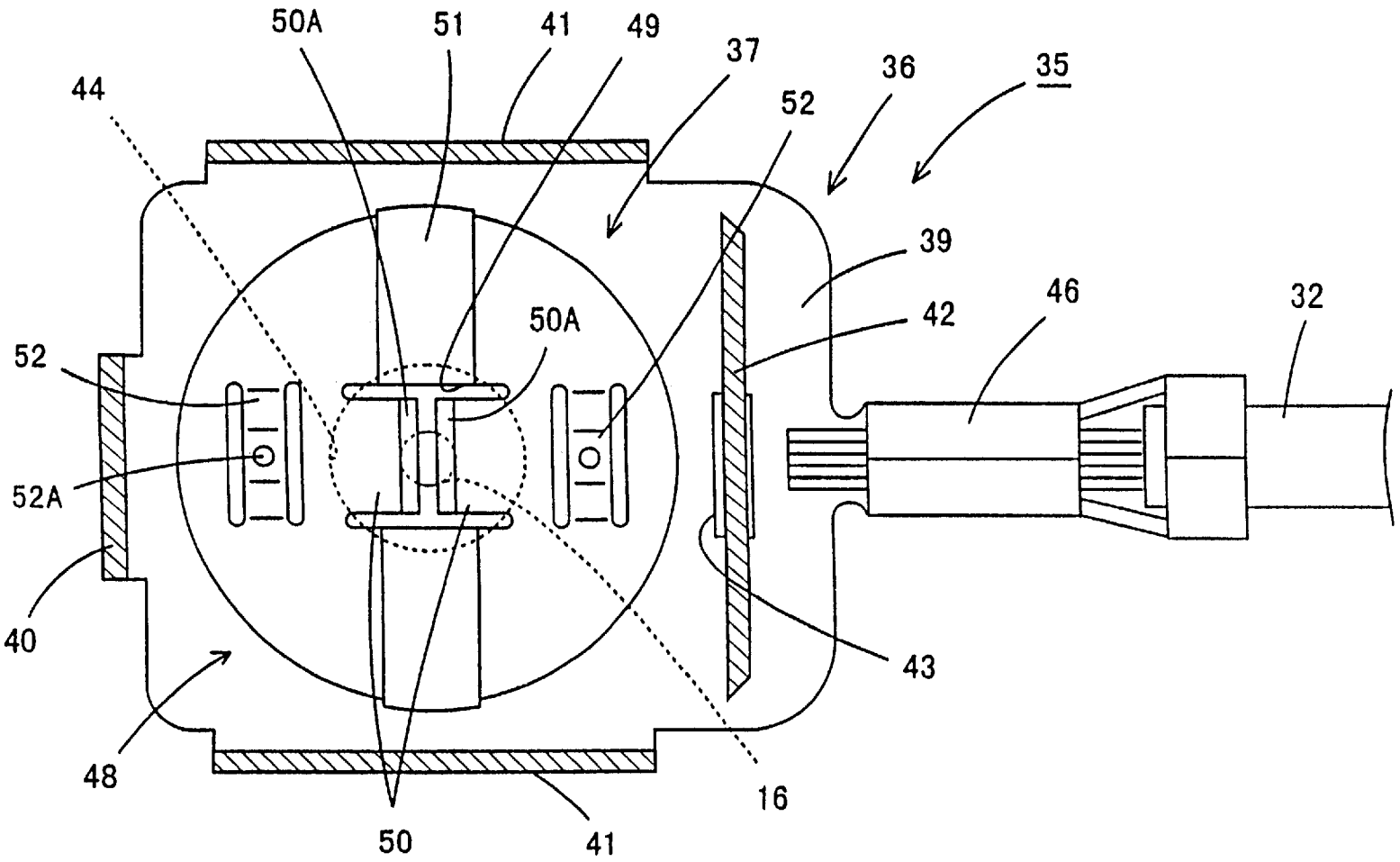
FIG. 6 is a partially cut-away plan view showing a connected state of the terminal fitting and a terminal member.
Figure 7:
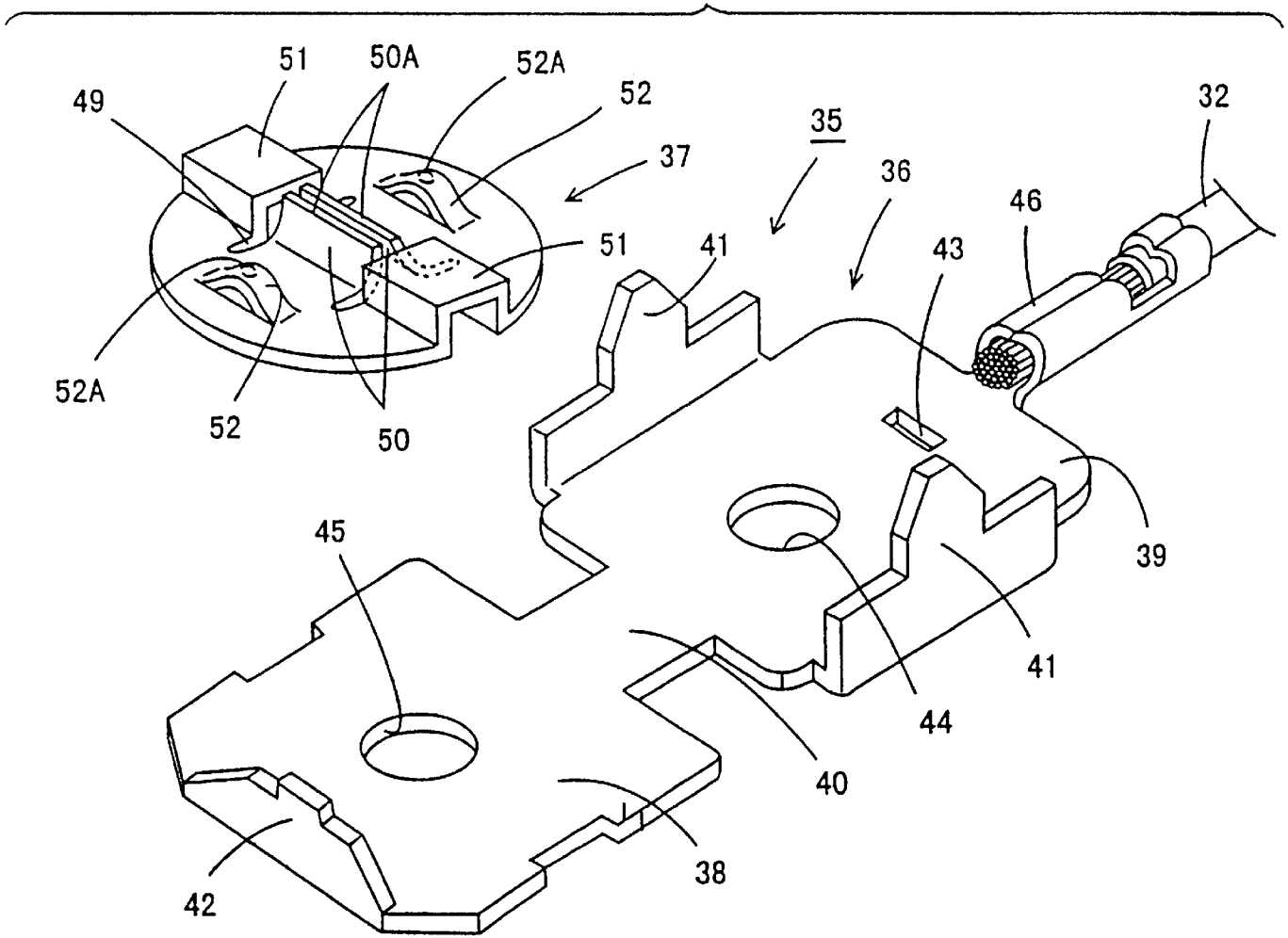
FIG. 7 is a diagonal view showing the terminal fitting in a state prior to joining.
Figure 8:
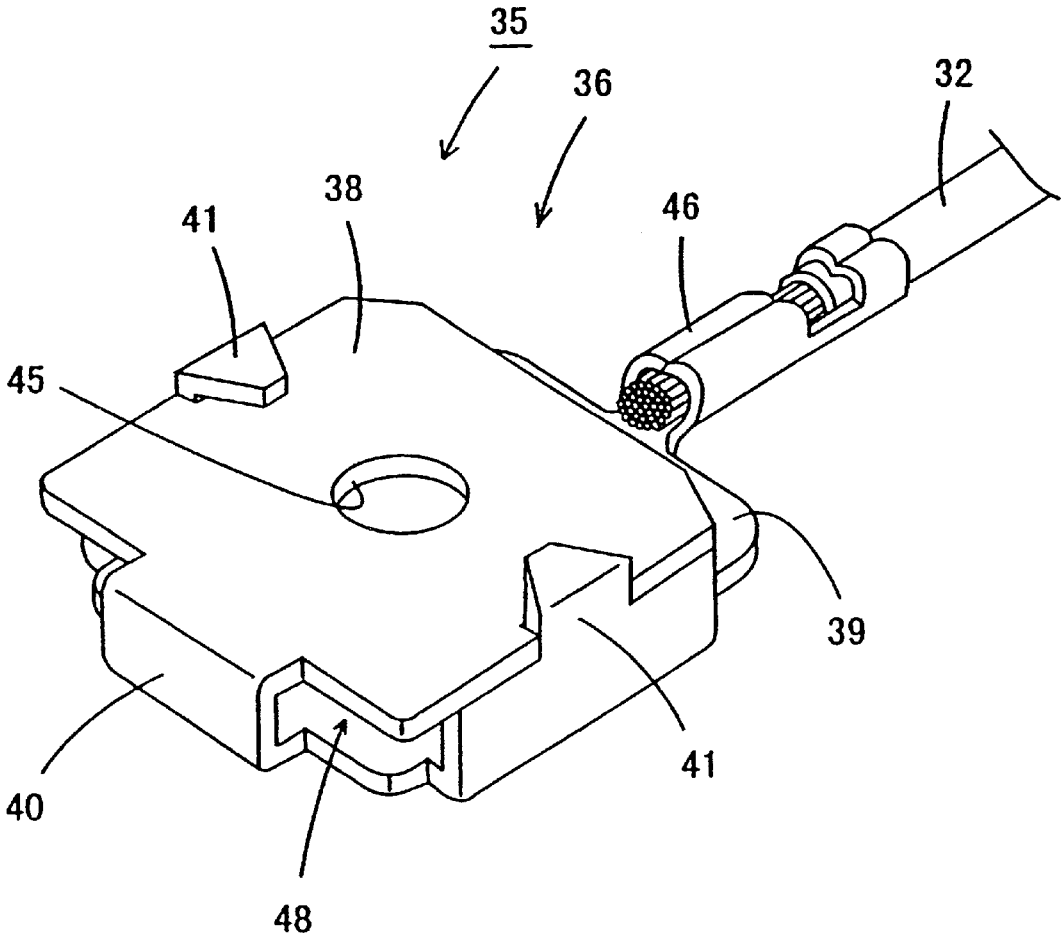
FIG. 8 is a diagonal view of a fixed terminal.

An embodiment of the present invention is explained below with the aid of FIGS. 1 to 8.

In the present embodiment, a solenoid unit for controlling oil pressure is provided within a gearbox casing of an automatic transmission of an automobile. This solenoid unit comprises a coil unit 10 and a connector 20 for providing electricity to the coil unit 10. When the connector unit 20 is joined to the coil unit 10 within the gearbox casing, the coil unit 10 and the connector unit 20 reach an electrically connected state. The connector 20 is connected to a wire harness outside the gearbox casing via an interrupted connector which passes through the gearbox casing, this connector unit 20 providing electricity from a battery to each coil 12 of the coil unit 10.

The coil unit 10 comprises a trapezoidal plate-shaped based plate 11. A plurality of coils 12 (five in the present embodiment) are distributed in specified locations on an upper face thereof, and are fixed thereto. Each coil 12 comprises element wire 12A wound around the outer circumference of a bobbin 13. A flange 14L at a lower end of the bobbin 13 fits into a coil attachment groove 15 of the base plate 11 and is fixed thereto by adhesive or other means, thereby unifying the bobbins 13 and the base plate 11. A flange 14U at an upper end of each bobbin 13 has a cross-sectionally circular, pin-like terminal member 16 fixed thereto in an upwardly protruding state, this terminal member 16 being composed of electrically conductive material.

An upper tip of each terminal member 16 has a tapered face 16A. A lower end of each terminal member 16 is fixed is an end of the element wires located below the flange 14U. The flanges 14U at the upper sides of these five coils 12 have the same height, allowing the connector 20 to be attached on these five flanges 14U. Within this coil unit 10, a movable core (not shown) protrudes downwards within a central hole 13A of each bobbin 13, this movable core being attached as to be movable in an axial direction. This forms the solenoid. When electricity is passed through the coils 12, this solenoid is magnetised and the movable core moves up and down, thereby controlling the oil pressure of the automatic transmission (not shown).

Next, the connector unit 20 will be explained. The connector unit 20 comprises a sheet-like housing 21, five terminal fittings 35 housed within the housing 21, and electric wires 32 connected to each terminal fitting 35. The housing 21 has a sheet-like base 22 covered by a sheet-like cover 23, this cover 23 having the same shape and size as the base 22. A space is formed between the base 22 and the cover 23, this space housing the terminal fittings 35 and the electric wires 32. Five terminal fitting housing grooves 24 are formed on an upper face of the base 22, these corresponding to the terminal members 16 of the coil unit 10. In addition, electric wire housing grooves 26 are formed on the upper face of the base 22, these electric wire housing grooves 26 like each terminal fitting housing groove 25 with electric wire outlet members 25 formed at the edge of an anterior side (the lower side in FIG. 3) of the base 22.

A lower face of the cover 23 has recesses 27 for preventing interference from tips of the terminal members 16 protruding into the terminal fitting housing grooves 24 of the base 22, pressing members 28 for preventing the terminal fittings 35 within the terminal fitting housing grooves 24 of the base 22 from rising upwards, and electric wire housing grooves 29 corresponding with the electric wire housing grooves 26 of the base 22.

Each terminal fitting housing groove 24A is approximately square in shape, a circular through hole 30 passing from the top to the bottom of the base 22 being formed in the centre thereof. These through holes 30 are distributed so as to be concentric with the terminal members 16 of the coil unit 10, the inner diameter of the through holes 30 being greater than the outer diameter of the terminal members 16. Moreover, the variation of tolerance between the outer diameter of the terminal members 16 and the inner diameter of the through holes 30 is identical with, or greater than, the maximum dimension of cumulative tolerance computed from the dimensional tolerance and attaching tolerance of the components of the coil unit 10 and the connector unit 20. Consequently, the terminal members 16 can be passed without difficultly through the through holes 30.

Each of the terminal fittings 35 comprises a fixed terminal 36 which connects with the electric wire 32, and a movable terminal 37 which connects with the terminal member 16. The fixed terminal 36 is formed from an upper plate 38 and a lower plate 39, these being joined at their anterior tips by a joining member 40, with a space being formed between the two plates. Stopping members 41 at the two side edges of the lower plate 39 are bent and are engaged by side edges of the upper plate 38. A stopping member 42 at the posterior edge of the upper plate 38 is inserted into a stopping hole 43 in the lower plate 39, this stopping member 42 being bent and thereby being retained therein. The upper and lower plates 38 and 39 are joined in a state whereby their opening out is regulated by the engagement of the stopping members 41 and 42. The fixed terminal 36 is square in its entirety and its movement in a horizontal direction (the direction perpendicular to the direction of joining of the two units 10 and 20) within the terminal fitting housing groove 24 is regulated; furthermore, it is housed so that is upwards movement is regulated by the pressing member 28. When the terminal fittings 35 are in a housed state, circular linking holes 44 formed in the lower plates 39 are positioned so as to be concentric with the through holes 30 of the housing 21. The inner diameter of the link holes 44 is greater than the inner diameter of the through holes 30. A circular hole 45 is formed in each upper plate 38, this hole 45 preventing interference from the terminal member 16 and having a core and diameter identical with that of linking holes 44 of the lower plates 39. In addition, a barrel member 46 protrudes from the posterior edge of the lower plate 39, the electric wire 32 being connected thereto by crimping. These electric wires 32 which have been crimped to the fixed terminals 36 extend along the electric wire housing grooves 26 as far as the electric wire outlet members 25, extend therefrom to the exterior of the housing 21, and connect with an outer connector 47.

Each movable terminal 37 is housed within a substantially square low space 48 surrounded by the upper and lower plates 38 and 39 of the fixed terminal 36, the stopping members 41 and 42 are the joining member 40. The movable terminal 37 is circular in shape, the diameter thereof being smaller than the inner dimensions, from left to right and from anterior to posterior, of the space 48. Consequently, the movable terminal 37 is capable of sliding freely in a two dimensional direction while making contact with the lower plate 39 within the space 48. The dimensions allowing movement of the movable terminals 37 (this is equal to the space between the outer edges of the movable terminals 37 and the joining member 40, or the space between the stopping members 41 and 42) is, as above, identical with, or greater than, the maximum dimension of cumulative tolerance calculated from the tolerances of the two units 10 and 20. Consequently, even in the case whereby the cumulative tolerance is at its maximum, the terminal members 16 and the movable terminals 37 can fit together.

The movable terminals 37 are formed by bending an oval-shaped sheet, an H-shaped slit 49 being formed in the centre thereof. By means of these slits 49 a pair of cantilever-shaped sheet members are bent into an arc shape and are made to change shape and protrude upwards, forming resilient contacts 50. The two end portion of the slit 49 are bent to become square rising members 51. As a result of this bending operation, two mutually parallel rising edges 50A of the two resilient contacts 50 are made to approach one another, the space between the two being smaller than the dimensions of the outer circumference of the terminal members 16. Further, the rising members 51 are in positions approaching the two ends of the rising edges 50A of the resilient contacts 50, the space between the two rising members 51 being greater than the dimensions of the outer circumference of the through holes 30. Since the rising members 51 are formed by making the resilient contacts 50 approach one another, the movable terminals 37 assume a circular shape when seen from a plan view.

Further, a pair of resilient contact members 52 are formed on the two sides at right angles to the rising members 51 of the resilient contacts 50. These resilient contact members 52 are formed by the conventional pressing process protruding upwards in a double-ended support bridge shape, embossed members 52A protruding from upper faces thereof. The resilient contact members 52 can bend resiliently downwards, their height in their free state being higher than the lower face of the upper plate 38. As a result, when the movable terminals 37 are in a housed state within the fixed terminals 36, the resilient contact members 52 bend resiliently and the embossed members 52A make resilient contact with the upper plate 38. The resilient contact members 52 permit the movable terminals 37 to slide freely in a two dimensional direction (the direction perpendicular to the direction of joining of the two units 10 and 20) but prevent the movable terminals 37 from rising upwards (in the direction of joining of the two units 10 and 20).

Next, the operation of the present embodiment will be explained.

When the connector unit 20 is to be joined to the coil unit 10, the housing 21 is positioned on the flanges 14U of the coils 12, the terminal members 16 are fixed in position on the housing 21 so as to correspond concentrically with the through holes 30 by a position fixing means (not shown) such as concave-convex surfaces, and the two units 10 and 20 are fixed by a means such as adhesive. At this juncture, the housing 21 is resting on the flanges 14U, and the five terminal members 16 pass through the respective through hoes 30 and the linking holes 44 and push through the space between the corresponding resilient contacts 50 of the terminal fittings 35, these resilient contacts 50 thereby changing shape resiliently and becoming wider. By this means the resilient contacts 50 grip both sides of the outer circumference face of the terminal members 16, the two making contact with a specified contact pressure. At this juncture, both resilient contacts 50 have a mutually identical degree of resilient bending.

Furthermore, when the two units 10 and 20 are to be joined together, there is the danger, due to the effects of tolerance, of a dislocation in position of the through holes 30 of the housing 21 relative to the terminal members 16, or of a dislocation in position of the movable terminals 37 within the fixed terminals 36 (within the space 48). As a result, there is danger that the terminal members 16 and the movable terminals 37 will be fitted together with a large dislocation in core alignment (dislocation in position) of the movable terminals 37 relative to the terminal members 16.

In the case where the dislocation is core alignment of the movable terminals 37 relative to the terminal members 16 is an up-down direction (relative to FIG. 6), the terminal members 16 are pushed through almost the exact centre of the two resilient contacts 50. As a result, the terminal fittings 35 are fitted in this position with the terminal members 16. Although the terminal members 16 are dislocated at this juncture in a sideways direction, they are gripped by the rising edges 50A of the resilient contacts 50. Since both resilient contacts 50 have a mutually identical degree of resilient bending, the specified contact pressure can be maintained.

In the case where the dislocation in core alignment relative to the terminal members 16 is in a left-right direction (relative to FIG. 6), the terminal members 16 enter between the two resilient contacts 50 in a state whereby the terminal members 16 are further towards one of these resilient contacts 50. At this juncture, the tips of the terminal members 16 make contact with bent faces of the resilient contacts 50, the movable terminals 37 thereby being caused to move in a left-right direction relative to FIG. 6, the terminal members 16 thereby attaining a position in the centre of the two resilient contacts 50. In this manner, the dislocation in core alignment is corrected, and the two resilient contacts 50 grip the terminal member 16 with the same degree of contact pressure.

In the case where the dislocation in core alignment is in a diagonal direction (relative to FIG. 6), the movable terminals 37 change position in a left-right direction, thereby correcting the dislocation in core alignment in that direction, the terminal member 16 being gripped between the two resilient contacts 50 at a position above or below the centre.

In the embodiment described above, the terminal fittings 35 comprise two pieces, the fixed terminals 36 and the movable terminals 37, the movable terminals 37 thereof being capable of moving in a direction perpendicular to the direction of joining of the two units 10 and 20. As a result, even if there is a dislocation in position between the terminal members 16 and the movable terminals 37 when the two units 10 and 20 are joined together, the movable terminals 37 change position, thereby correcting this dislocation in position and allowing them to fit correctly with the terminal members 16. Consequently, the terminal fittings 35 and the terminal members 16 can fit together without hindrance.

The absorption of the dislocation in position is not obtained by causing a certain portion of a certain component to change shape resiliently. Rather, this is obtained by the free movement of the independent movable terminals 37. Consequently the range of movement, that is, the tolerance for absorbing the dislocation in position, can be specified at one's discretion. As a result, even in the case whereby the cumulative tolerance arising from the components and the fitting together of the two units 10 and 20 is great, correspondence can still be attained.

When the movable terminals 37 change position, the resilient contact members 52 thereof maintain contact pressure by means of their resilient force while making sliding contact with the upper plate 38. Consequently, the reliability of the contact between the fixed terminals 36 and the movable terminals 37 can be maintained.

Additionally, it is possible that, when the movable terminals 37 move to correct the dislocation in position with the terminal members 16, the movable terminals 37 move diagonally instead of retaining a fixed orientation and moving in a parallel direction, If the terminal members have a plate-shape, there is the danger that, when the movable terminals 37 become diagonally aligned, the bending force of the resilient contacts 50 increases and their contact force becomes too great. However, in the present embodiment, the terminal members 16 are cross-sectionally circular and have an upwardly protruding shape. Consequently, the movable terminals 37 change their orientation while keeping the terminal members 16 as their centre and the resilient contacts 50 of the movable terminals 37 retain their specified bending force. Consequently, changes in the contact force of the terminal members 16 and the terminal fittings 35 can be avoided.

The present invention is not limited to the embodiments described above with the aid of figures. For example, the possibilities described below also lie within the technical range of the present invention. In addition, the present invention may be embodies in various other ways without deviating from the scope thereof.

(1) In the present embodiment, the fixed terminals grip the movable terminals in a sandwich shape. However, according to the present invention, the fixed terminals may equally well support the movable terminals merely by gripping circumference edge portions thereof.

(2) The present embodiment has described the conducting wire member as an electric wire. However, according to the present invention, the conducting wire member may equally well be a busbar either unified with the fixed terminals or separate therefrom.

(3) In the present embodiment, the connecting form of the coil unit has a protruding shape and the connecting form of the connector unit has a hole shape. However, according to the present invention, the coil unit may equally well have a hole shape and the connector unit may have a protrusion.

(4) In the present embodiment, the terminal members of the coil unit have a round pin-shape. However, according to the present invention, the terminal members may equally well have a square pin-shape, a plate-shape, etc.

(5) In the present embodiment, the resilient contacts are provided as a pair. However, according to the present invention, a single resilient contact may be provided, this making contact with the terminal member by pressing against it from the side.

(6) In the present embodiment, the resilient contact members are formed only on the movable terminals. However, according to the present invention, the resilient contact members may be formed on the fixed terminals, or on both the fixed terminal and the movable terminals.

What is claimed is:

1. An electrical coil unit comprising a base, a plurality of coils distributed on the base and each having a terminal, and a connector having a plurality of contacts engageable one each with said terminals; characterised in that said terminals and contacts have a fitting direction, and each of said contacts comprises two discrete components, one of said components being a fixed conductor and one said of components being a separate movable conductor, said movable conductors being engageable with the terminals, said fixed conductors being immovable with respect to said connector, and each of said movable conductors being in electrical contact with a respective fixed conductor and contained by the fixed conductor so as to be movable with respect thereto substantially only in directions perpendicular to said fitting direction.

2. A unit according to claim 1 wherein said fixed conductors have resilient contact members thereon for contact with said movable conductors.

3. A unit according to claim 1 wherein said movable conductors have resilient contact members thereon for contact with said fixed conductors.

4. A unit according to claim 1 wherein said terminals comprise upstanding pins.

5. A unit according to claim 4 wherein said pins are circular in cross-section.

6. A unit according to claim 4 wherein said movable conductors have resilient arms thereon for electrical contact with said pins.

7. A unit according to claim 5 wherein said movable conductors have resilient arms thereon for electrical contact with said pins.

8. A unit according to claim 6 wherein said movable conductors comprise a base having an aperture therethrough, said resilient arms being on either side of said aperture, and the spacing between said arms being less than the thickness of said pins.

9. A unit according to claim 7 wherein said movable conductors comprise a base having an aperture with a spacing therebetween therethrough, said resilient arms being on either side of said aperture, and the spacing between said arms being less than the thickness of said pins.

10. A unit according to claim 1 wherein said fixed conductor has a peripheral wall to confine relative movement of said movable conductors.

11. A unit according to claim 10 wherein said fixed conductor substantially encloses said movable conductors.

12. A unit according to claim 11 wherein said fixed conductor comprises a folded sheet metal blank, said blank including an upstanding member defining a protrusion for engagement in a corresponding opening in the blank, thereby to define a chamber for said movable conductor.

13. A unit according to claim 1 wherein said connector includes a chamber for each of saids contacts, and a pressing member in each chamber to prevent movement of said contacts in the fitting direction.

14. A unit according to claim 1 wherein each said fixed conductor defines a substantially square narrow space with upper and lower plates to house and surround one of the movable conductors.

* * * * *